US008485949B2

(12) United States Patent
Hsu

(10) Patent No.: US 8,485,949 B2
(45) Date of Patent: Jul. 16, 2013

(54) ELASTIC EXERCISING BAR ASSEMBLY THAT IS OPERATED IN A SWINGING MANNER

(76) Inventor: Chi-Kun Hsu, Chang Hua Hsien (TW)

( * ) Notice: Subject to any disclaimer, the term of this patent is extended or adjusted under 35 U.S.C. 154(b) by 224 days.

(21) Appl. No.: 13/155,452

(22) Filed: Jun. 8, 2011

(65) Prior Publication Data

US 2012/0316040 A1 Dec. 13, 2012

(51) Int. Cl.
*A63B 21/00* (2006.01)

(52) U.S. Cl.
USPC ..... 482/121; 482/126; 482/110

(58) Field of Classification Search
USPC ..... 482/121, 126, 110, 101, 148
See application file for complete search history.

(56) References Cited

U.S. PATENT DOCUMENTS

| | | | | |
|---|---|---|---|---|
| 6,752,747 | B2 * | 6/2004 | Yu | 482/110 |
| 6,872,174 | B2 * | 3/2005 | Benach | 482/121 |
| 2004/0242387 | A1 * | 12/2004 | Benach | 482/126 |
| 2005/0233877 | A1 * | 10/2005 | Lin | 482/126 |
| 2010/0240505 | A1 * | 9/2010 | Yang | 482/126 |

* cited by examiner

*Primary Examiner* — Jerome W Donnelly
(74) *Attorney, Agent, or Firm* — Che-Yang Chen; Law Office of Michael Chen

(57) ABSTRACT

An exercising bar assembly includes a holding unit and two opposite swinging units each removably mounted on the holding unit. Thus, each of the two swinging units can be removed from the holding unit when not in use to reduce the whole volume of the exercising bar assembly and to facilitate storage, packaging, carrying and transportation of the exercising bar assembly.

17 Claims, 6 Drawing Sheets

ELASTIC EXERCISING BAR ASSEMBLY THAT IS OPERATED IN A SWINGING MANNER

BACKGROUND OF THE INVENTION

1. Field of the Invention

The present invention relates to an exercising device and, more particularly, to an elastic exercising bar assembly that is operated in a swinging manner.

2. Description of the Related Art

A conventional exercising bar assembly 30 in accordance with the prior art shown in FIG. 6 comprises a handgrip 32 and two swinging bars 31 secured on two opposite ends of the handgrip 32. Each of the two swinging bars 31 has a first end inserted into and secured in the handgrip 32 and a second end provided with a weight member 33. In operation, when the handgrip 32 is swung and vibrated by a user, the two swinging bars 31 are moved and revolved relative to the handgrip 32. In such a manner, the weight member 33 of each of the two swinging bars 31 applies a damping force to the user so that the user has to apply a larger force to overcome the load of the weight member 33 of each of the two swinging bars 31 so as to achieve an exercising effect. However, each of the two swinging bars 31 is fixed on and cannot be removed from the handgrip 32 so that the exercising bar assembly 30 has a larger volume when not in use, thereby causing inconvenience in storage, packaging, carrying and transportation of the exercising bar assembly 30. In addition, an external stress is applied on the connection of the handgrip 32 and each of the two swinging bars 31 so that each of the two swinging bars 31 is easily broken due to a stress concentration, thereby decreasing the lifetime of the exercising bar assembly 30.

BRIEF SUMMARY OF THE INVENTION

In accordance with the present invention, there is provided an exercising bar assembly, comprising a holding unit and two opposite swinging units each removably mounted on the holding unit. The holding unit includes an elastic member, two connecting members mounted on two opposite ends of the elastic member, and a handgrip surrounding the elastic member. Each of the two swinging units includes a support tube detachably mounted on a respective one of the two connecting members of the holding unit, a limit cap removably mounted on a respective one of the two connecting members of the holding unit and abutting the support tube to limit the support tube on the respective connecting member of the holding unit, and a swinging bar secured on the support tube and protruded outward from the limit cap.

The elastic member of the holding unit has an interior provided with a mounting space. Each of the two connecting members of the holding unit has a first end provided with a mounting portion inserted into the mounting space of the elastic member and a second end provided with an outer threaded portion. Each of the two connecting members of the holding unit has interior provided with a receiving recess to receive the support tube of a respective one of the two swinging units. The support tube of each of the two swinging units has a first end inserted into the receiving recess of the respective connecting member of the holding unit and a second end provided with an abutting face. The limit cap of each of the two swinging units has a first end provided with an inner threaded portion screwed onto the outer threaded portion of the respective connecting member of the holding unit and a second end provided with a through hole to allow passage of the swinging bar. The limit cap of each of the two swinging units has a mediate portion provided with a limit edge abutting the abutting face of the support tube. The support tube of each of the two swinging units has an interior provided with a fixing hole for fixing the swinging bar. The swinging bar of each of the two swinging units has a first end provided with a fixing portion inserted into and fixed in the fixing hole of the support tube and a second end provided with a weight member.

According to the primary advantage of the present invention, when the inner threaded portion of the limit cap of each of the two swinging units is unscrewed from the outer threaded portion of the respective connecting member of the holding unit, the support tube of each of the two swinging units is released by the limit cap and is detached from the receiving recess of the respective connecting member of the holding unit so that each of the two swinging units can be removed from the holding unit when not in use to reduce the whole volume of the exercising bar assembly and to facilitate storage, packaging, carrying and transportation of the exercising bar assembly.

According to another advantage of the present invention, the elastic member of the holding unit provides a buffering force to reduce an external stress applied on the connection of the swinging bar and the support tube of each of the two swinging units to prevent the swinging bar of each of the two swinging units from being broken due to a stress concentration so as to enhance the lifetime of the exercising bar assembly.

According to a further advantage of the present invention, each of the two connecting members of the holding unit connects the elastic member of the holding unit and the swinging bar of the respective swinging unit so that the handgrip of the holding unit is swayed in concert with the weight member of the swinging bar of the respective swinging unit to increase the vibration amplitude of the weight member of the swinging bar of the respective swinging unit so as to enhance the exercising effect to the user.

According to a further advantage of the present invention, a clearance is defined between the swinging bar and the through hole of the limit cap of each of the two swinging units so that the swinging bar of each of the two swinging units will not touch the limit cap and will not be worn out or broken by rubbing actions of the limit cap during the movement so as to enhance the lifetime of the exercising bar assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
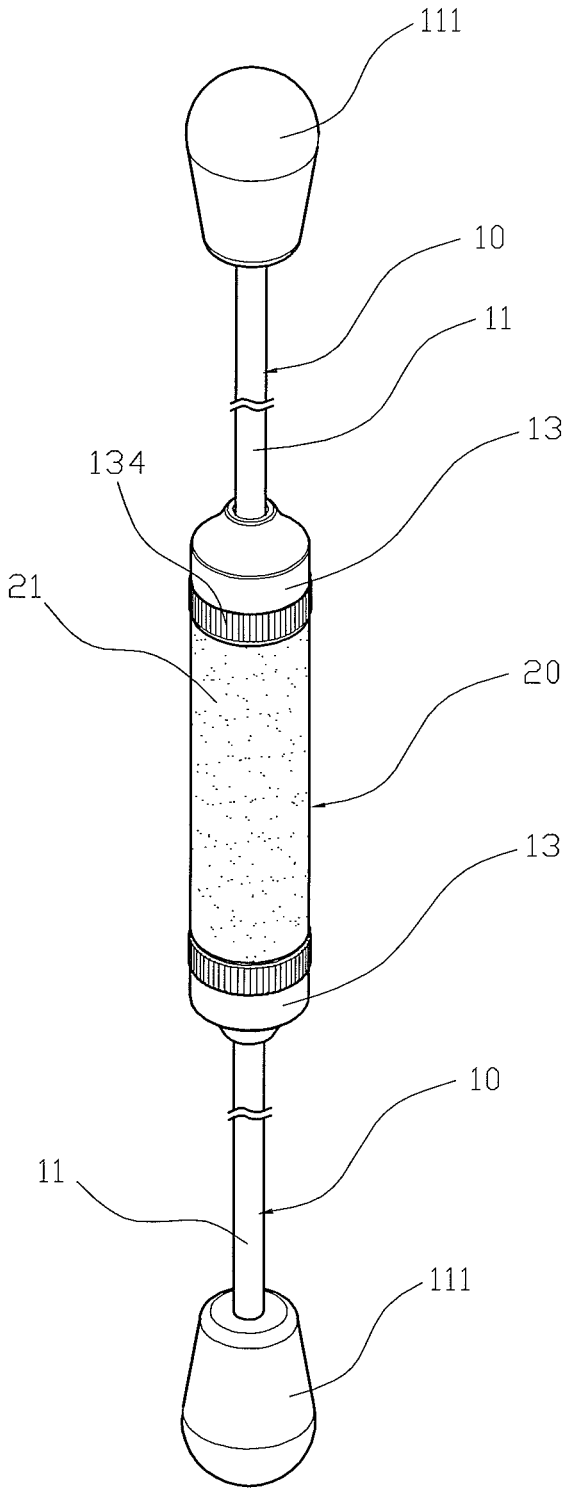
FIG. 1 is a perspective view of an exercising bar assembly in accordance with the preferred embodiment of the present invention.
Figure 2:
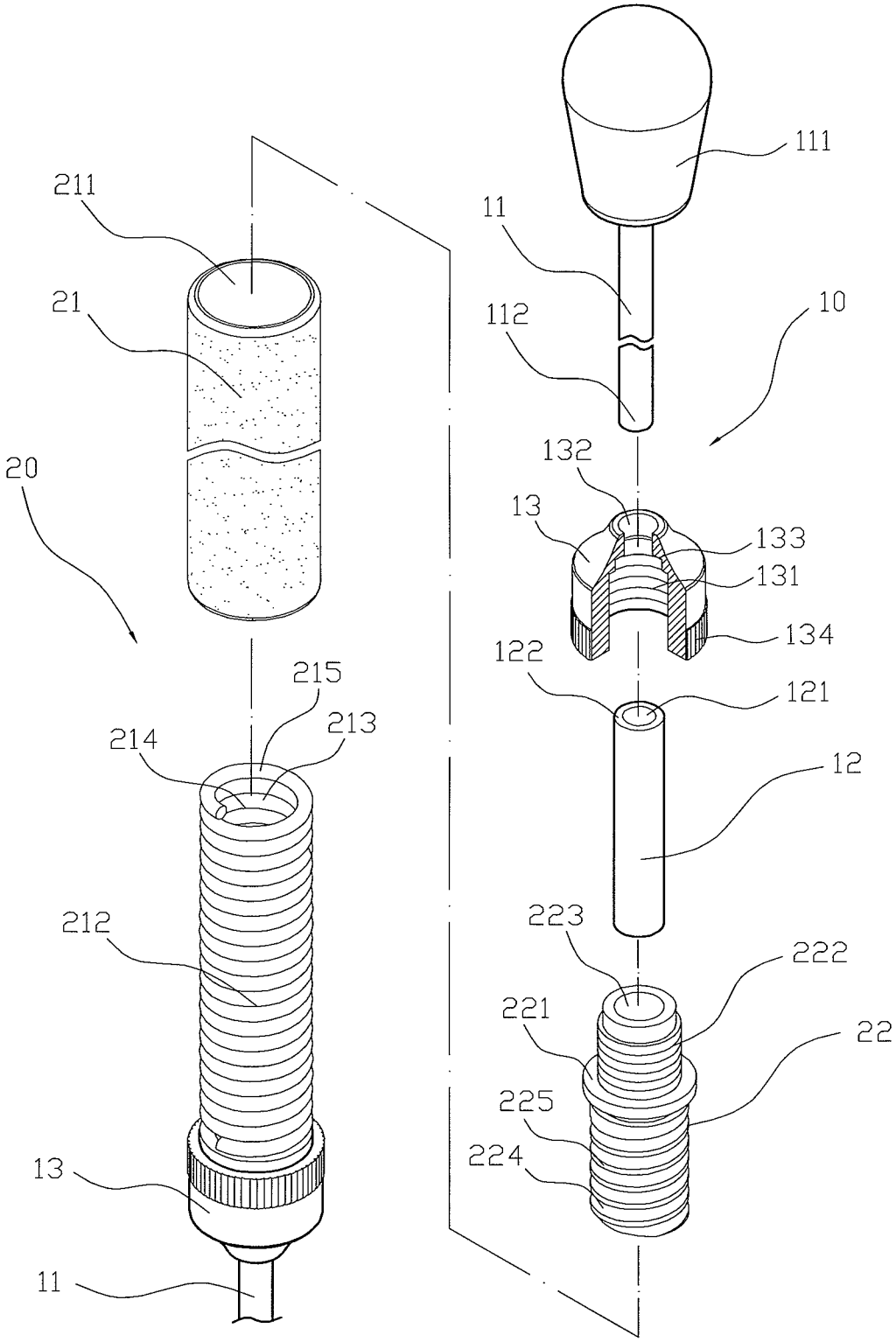
FIG. 2 is a partially exploded perspective view of the exercising bar assembly as shown in FIG. 1.
Figure 3:
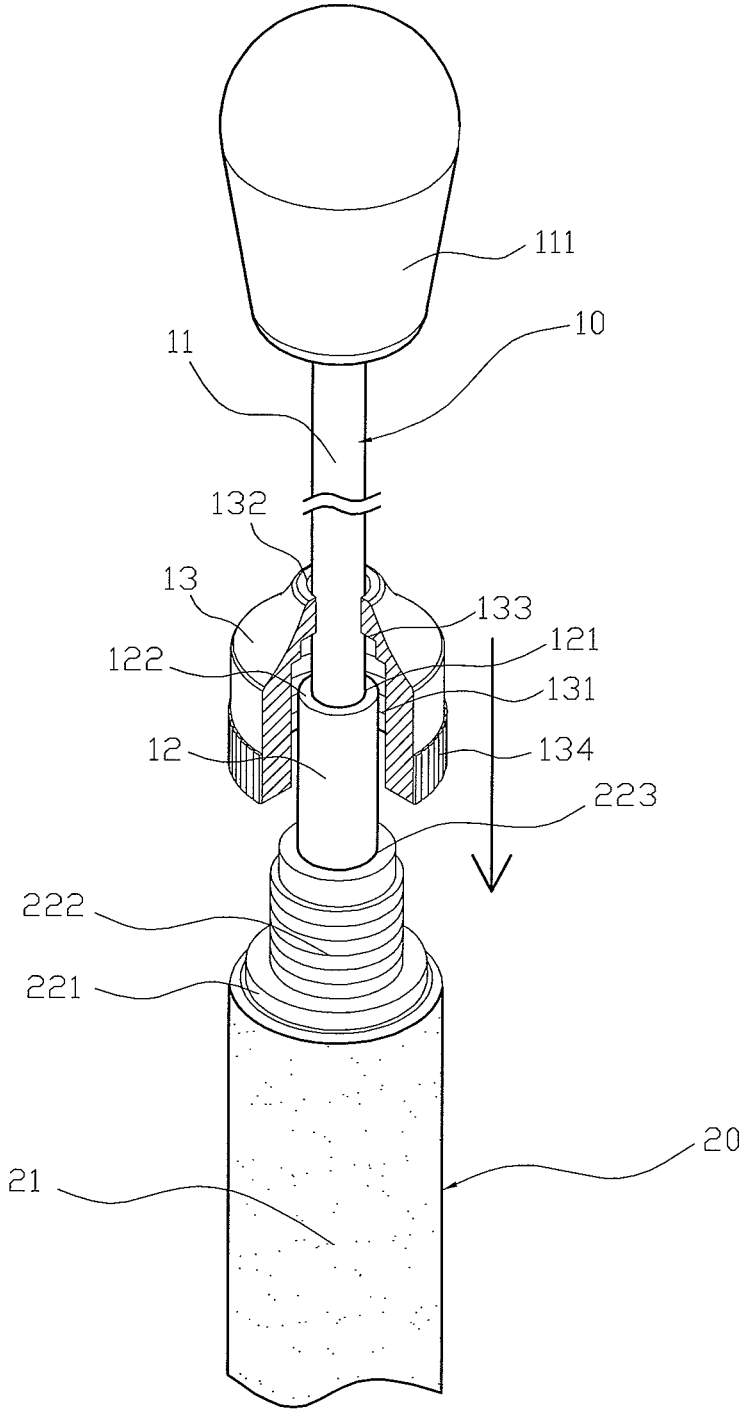
FIG. 3 is a partially exploded perspective cross-sectional view of the exercising bar assembly as shown in FIG. 1.
Figure 4:
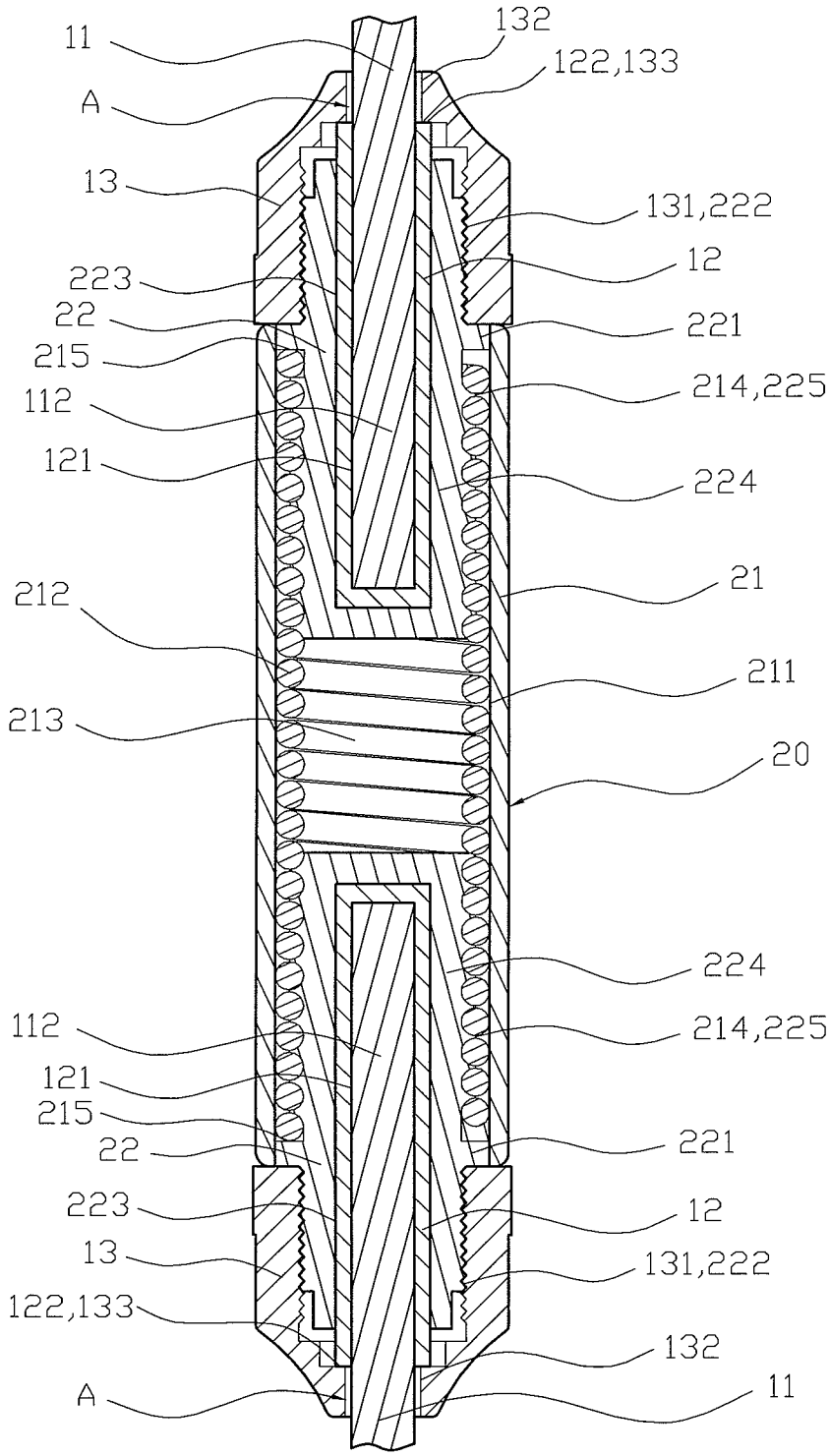
FIG. 4 is a partially front cross-sectional view of the exercising bar assembly as shown in FIG. 1.

Referring to the drawings and initially to FIGS. 1-4, an exercising bar assembly in accordance with the preferred embodiment of the present invention comprises a holding unit 20 and two opposite swinging units 10 each removably mounted on the holding unit 20. The holding unit 20 includes an elastic member 212, two connecting members 22 mounted on two opposite ends of the elastic member 212, and a handgrip 21 surrounding the elastic member 212. Each of the two swinging units 10 includes a support tube 12 detachably mounted on a respective one of the two connecting members 22 of the holding unit 20, a limit cap 13 removably mounted on a respective one of the two connecting members 22 of the holding unit 20 and abutting the support tube 12 to limit the support tube 12 on the respective connecting member 22 of the holding unit 20, and a swinging bar 11 secured on the support tube 12 and protruded outward from the limit cap 13.

The handgrip 21 of the holding unit 20 is made of a resilient material. The handgrip 21 of the holding unit 20 has a tubular shape and has an interior provided with a mounting hole 211 mounted on the elastic member 212.

The elastic member 212 of the holding unit 20 is received in and fully hidden in the mounting hole 211 of the handgrip 21. The elastic member 212 of the holding unit 20 is a helical spring and has an interior provided with a mounting space 213. Each of the two opposite ends of the elastic member 212 is provided with an open end portion 215 connected to the mounting space 213. The mounting space 213 of the elastic member 212 of the holding unit 20 has a peripheral wall provided with an internal thread 214.

Each of the two connecting members 22 of the holding unit 20 has a first end provided with a mounting portion 224 inserted into the mounting space 213 of the elastic member 212 and a second end provided with an outer threaded portion 222. The mounting portion 224 of each of the two connecting members 22 of the holding unit 20 has a peripheral wall provided with an external thread 225 screwed into the internal thread 214 of the elastic member 212 of the holding unit 20. Each of the two connecting members 22 of the holding unit 20 has a mediate portion provided with a stop flange 221 abutting the respective open end portion 215 of the elastic member 212. The stop flange 221 of each of the two connecting members 22 is disposed between the mounting portion 224 and the outer threaded portion 222 and is fully hidden in the mounting hole 211 of the handgrip 21. The stop flange 221 of each of the two connecting members 22 has an annular shape and extends outward from an outer wall of each of the two connecting members 22. Each of the two connecting members 22 of the holding unit 20 has interior provided with a receiving recess 223 to receive the support tube 12 of a respective one of the two swinging units 10.

The support tube 12 of each of the two swinging units 10 is located between the respective connecting member 22 of the holding unit 20 and the limit cap 13. The support tube 12 of each of the two swinging units 10 has a first end inserted into the receiving recess 223 of the respective connecting member 22 of the holding unit 20 and a second end provided with an abutting face 122. The abutting face 122 of the support tube 12 of each of the two swinging units 10 is protruded outward from the receiving recess 223 of the respective connecting member 22 of the holding unit 20. The support tube 12 of each of the two swinging units 10 has an interior provided with a fixing hole 121 for fixing the swinging bar 11.

The limit cap 13 of each of the two swinging units 10 has a first end provided with an inner threaded portion 131 screwed onto the outer threaded portion 222 of the respective connecting member 22 of the holding unit 20 and a second end provided with a through hole 132 to allow passage of the swinging bar 11. The limit cap 13 of each of the two swinging units 10 has a mediate portion provided with a limit edge 133 abutting the abutting face 122 of the support tube 12. The limit edge 133 of the limit cap 13 of each of the two swinging units 10 has a stepped shape and is disposed between the inner threaded portion 131 and the through hole 132. The through hole 132 of the limit cap 13 of each of the two swinging units 10 is connected to the fixing hole 121 of the support tube 12 and has a size smaller than that of the inner threaded portion 131. The limit cap 13 of each of the two swinging units 10 has an outer wall provided with a serrated portion 134 to provide an antiskid effect.

The swinging bar 11 of each of the two swinging units 10 is made of a composite fiber material (such as carbon fiber or glass fiber) and has a substantially circular cross-sectional profile. The swinging bar 11 of each of the two swinging units 10 is extended through the through hole 132 of the limit cap 13 and has a first end provided with a fixing portion 112 inserted into and fixed in the fixing hole 121 of the support tube 12 and a second end provided with a weight member 111. The fixing portion 112 of the swinging bar 11 of each of the two swinging units 10 is fixed in the fixing hole 121 of the support tube 12 by a gel or in an injection coating manner. The swinging bar 11 of each of the two swinging units 10 has a size smaller than that of the through hole 132 of the limit cap 13 so that a clearance "A" is defined between the swinging bar 11 and the through hole 132 of the limit cap 13 of each of the two swinging units 10.

Figure 5:
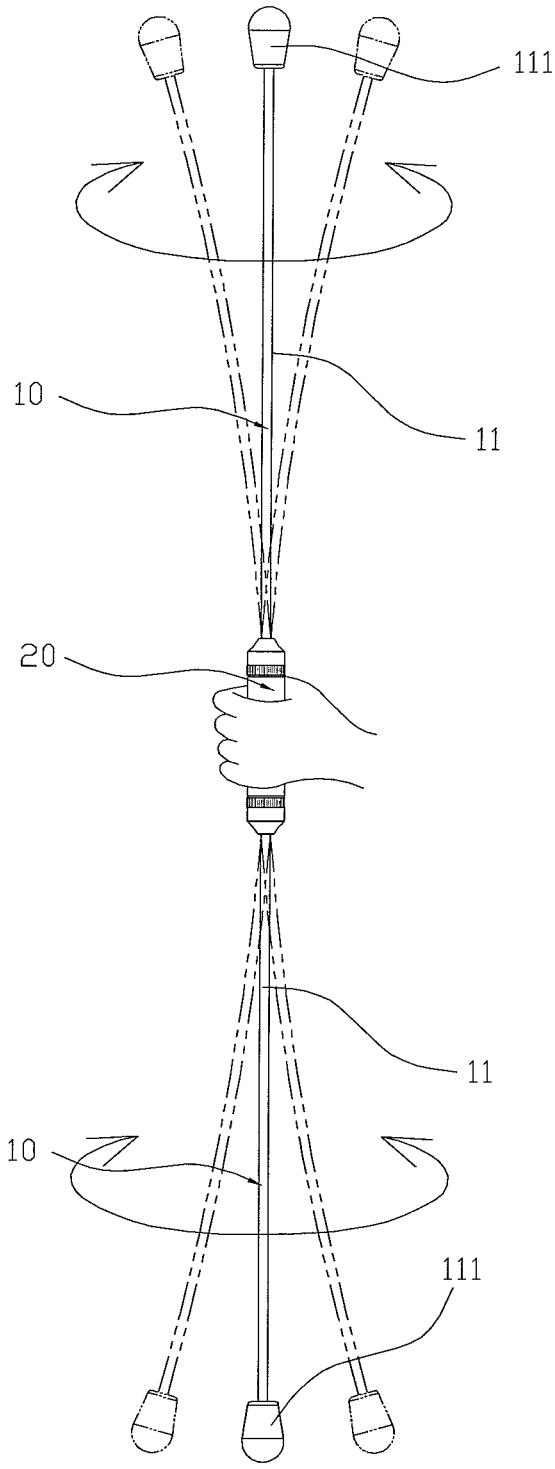
FIG. 5 is a schematic front operational view of the exercising bar assembly as shown in FIG. 1 in use.
Figure 6:
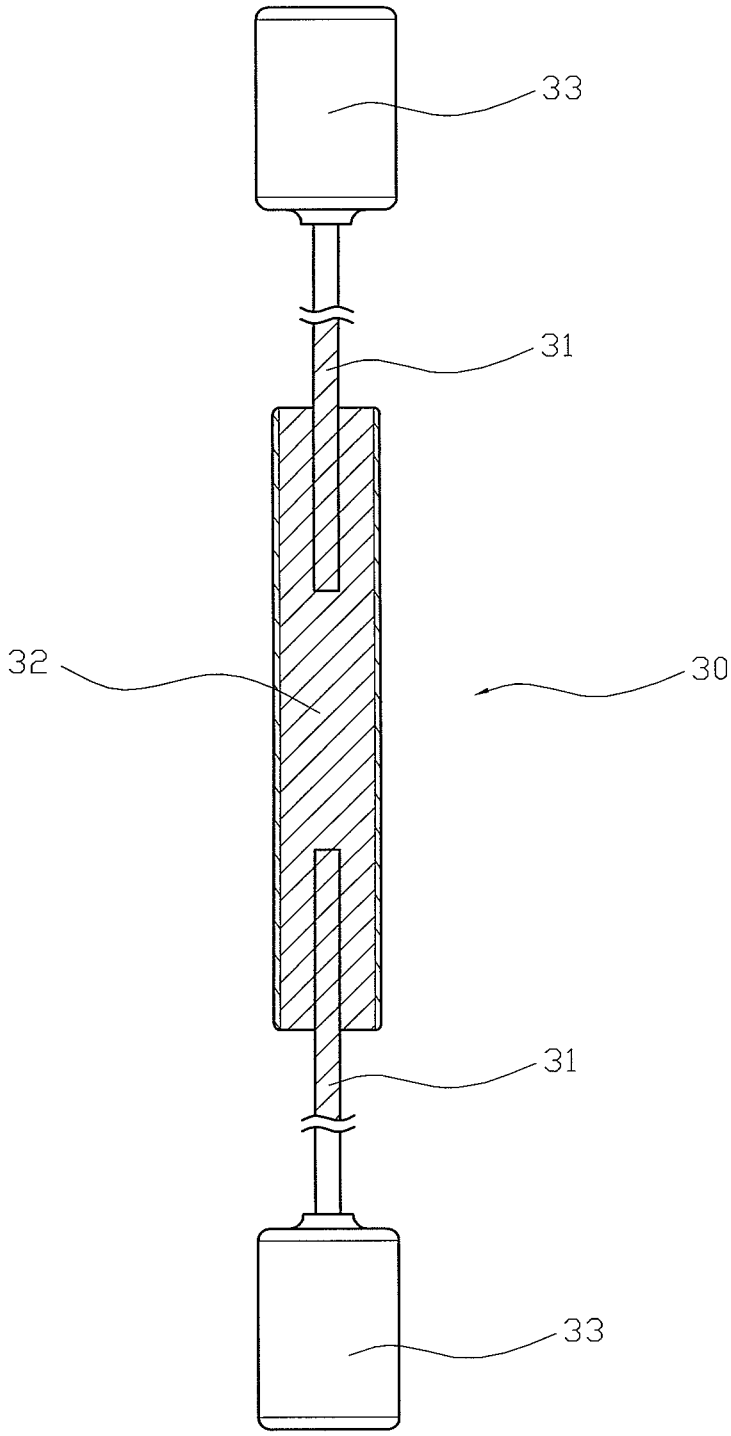
FIG. 6 PRIOR ART
FIG. 6 is a front cross-sectional view of a conventional exercising bar assembly in accordance with the prior art.

In operation, referring to FIG. 5 with reference to FIGS. 1-4, when the holding unit 20 is swung and vibrated by a user, the two swinging units 10 are moved and revolved relative to the holding unit 20 as shown in FIG. 5. In such a manner, the weight member 111 of each of the two swinging units 10 applies a damping force to the user so that the user has to apply a force to overcome the load of the weight member 111 of each of the two swinging units 10 so as to achieve an exercising effect. At this time, each of the two connecting members 22 of the holding unit 20 is located between the elastic member 212 of the holding unit 20 and the swinging bar 11 of the respective swinging unit 10 so that the handgrip 21 of the holding unit 20 is swayed in concert with the weight member 111 of the swinging bar 11 of the respective swinging unit 10 to increase the vibration amplitude of the weight member 111 of the swinging bar 11 of the respective swinging unit 10 so as to enhance the exercising effect. In addition, a clearance "A" is defined between the swinging bar 11 and the through hole 132 of the limit cap 13 of each of the two swinging units 10 so that the swinging bar 11 of each of the two swinging units 10 will not touch the limit cap 13 and will not be worn out or broken by rubbing actions of the limit cap 13 during the movement so as to enhance the lifetime of the exercising bar assembly. Further, the elastic member 212 of the holding unit 20 provides a buffering force to reduce the stress applied on the connection of the swinging bar 11 and the support tube 12 of each of the two swinging units 10 to prevent the swinging bar 11 of each of the two swinging units 10 from being broken due to a stress concentration so as to enhance the lifetime of the exercising bar assembly.

Accordingly, when the inner threaded portion 131 of the limit cap 13 of each of the two swinging units 10 is unscrewed from the outer threaded portion 222 of the respective connecting member 22 of the holding unit 20, the support tube 12 of each of the two swinging units 10 is released by the limit cap 13 and is detached from the receiving recess 223 of the respective connecting member 22 of the holding unit 20 so that each of the two swinging units 10 can be removed from the holding unit 20 when not in use to reduce the whole volume of the exercising bar assembly and to facilitate storage, packaging, carrying and transportation of the exercising bar assembly. In addition, the elastic member 212 of the holding unit 20 provides a buffering force to reduce an external stress applied on the connection of the swinging bar 11 and the support tube 12 of each of the two swinging units 10 to prevent the swinging bar 11 of each of the two swinging units 10 from being broken due to a stress concentration so as to enhance the lifetime of the exercising bar assembly. Further, each of the two connecting members 22 of the holding unit 20 connects the elastic member 212 of the holding unit 20 and the swinging bar 11 of the respective swinging unit 10 so that the handgrip 21 of the holding unit 20 is swayed in concert with the weight member 111 of the swinging bar 11 of the respective swinging unit 10 to increase the vibration amplitude of the weight member 111 of the swinging bar 11 of the respective swinging unit 10 so as to enhance the exercising effect to the user. Further, a clearance "A" is defined between the swinging bar 11 and the through hole 132 of the limit cap 13 of each of the two swinging units 10 so that the swinging bar 11 of each of the two swinging units 10 will not touch the limit cap 13 and will not be worn out or broken by rubbing actions of the limit cap 13 during the movement so as to enhance the lifetime of the exercising bar assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising bar assembly, comprising:

a holding unit; and two opposite swinging units each removably mounted on the holding unit;

wherein the holding unit includes:

an elastic member;

two connecting members mounted on two opposite ends of the elastic member; and a handgrip surrounding the elastic member;

each of the two swinging units includes:

a support tube detachably mounted on a respective one of the two connecting members of the holding unit;

a limit cap removably mounted on a respective one of the two connecting members of the holding unit and abutting the support tube to limit the support tube on the respective connecting member of the holding unit; and a swinging bar secured on the support tube and protruded outward from the limit cap.

2. The exercising bar assembly of claim 1, wherein the elastic member of the holding unit has an interior provided with a mounting space;

each of the two connecting members of the holding unit has a first end provided with a mounting portion inserted into the mounting space of the elastic member and a second end provided with an outer threaded portion;

each of the two connecting members of the holding unit has interior provided with a receiving recess to receive the support tube of a respective one of the two swinging units;

the support tube of each of the two swinging units has a first end inserted into the receiving recess of the respective connecting member of the holding unit and a second end provided with an abutting face;

the limit cap of each of the two swinging units has a first end provided with an inner threaded portion screwed onto the outer threaded portion of the respective connecting member of the holding unit and a second end provided with a through hole to allow passage of the swinging bar;

the limit cap of each of the two swinging units has a mediate portion provided with a limit edge abutting the abutting face of the support tube.

3. The exercising bar assembly of claim 2, wherein each of the two opposite ends of the elastic member is provided with an open end portion connected to the mounting space;

each of the two connecting members of the holding unit has a mediate portion provided with a stop flange abutting the respective open end portion of the elastic member.

4. The exercising bar assembly of claim 3, wherein the stop flange of each of the two connecting members is disposed between the mounting portion and the outer threaded portion.

5. The exercising bar assembly of claim 2, wherein the limit edge of the limit cap of each of the two swinging units is disposed between the inner threaded portion and the through hole.

6. The exercising bar assembly of claim 3, wherein the handgrip of the holding unit has an interior provided with a mounting hole mounted on the elastic member.

7. The exercising bar assembly of claim 2, wherein the support tube of each of the two swinging units is located between the respective connecting member of the holding unit and the limit cap;

the support tube of each of the two swinging units has an interior provided with a fixing hole for fixing the swinging bar;

the swinging bar of each of the two swinging units has a first end provided with a fixing portion inserted into and fixed in the fixing hole of the support tube and a second end provided with a weight member;

the through hole of the limit cap of each of the two swinging units is connected to the fixing hole of the support tube.

8. The exercising bar assembly of claim 2, wherein the mounting space of the elastic member of the holding unit has a peripheral wall provided with an internal thread;

the mounting portion of each of the two connecting members of the holding unit has a peripheral wall provided with an external thread screwed into the internal thread of the elastic member of the holding unit.

9. The exercising bar assembly of claim 3, wherein the stop flange of each of the two connecting members extends outward from an outer wall of each of the two connecting members.

10. The exercising bar assembly of claim 2, wherein the abutting face of the support tube of each of the two swinging units is protruded outward from the receiving recess of the respective connecting member of the holding unit.

11. The exercising bar assembly of claim 7, wherein the swinging bar of each of the two swinging units is extended through the through hole of the limit cap;

the swinging bar of each of the two swinging units has a size smaller than that of the through hole of the limit cap;

a clearance is defined between the swinging bar and the through hole of the limit cap of each of the two swinging units.

12. The exercising bar assembly of claim 1, wherein the swinging bar of each of the two swinging units is made of a composite fiber material.

13. The exercising bar assembly of claim 1, wherein the swinging bar of each of the two swinging units has a circular cross-sectional profile.

14. The exercising bar assembly of claim 1, wherein the elastic member of the holding unit is a helical spring.

15. The exercising bar assembly of claim 7, wherein the fixing portion of the swinging bar of each of the two swinging units is fixed in the fixing hole of the support tube by a gel.

16. The exercising bar assembly of claim 7, wherein the fixing portion of the swinging bar of each of the two swinging units is fixed in the fixing hole of the support tube in an injection coating manner.

17. The exercising bar assembly of claim 6, wherein the elastic member of the holding unit is received in and fully hidden in the mounting hole of the handgrip;

the stop flange of each of the two connecting members is fully hidden in the mounting hole of the handgrip;

the limit edge of the limit cap of each of the two swinging units has a stepped shape;

the through hole of the limit cap of each of the two swinging units has a size smaller than that of the inner threaded portion.

* * * * *